US008517609B2

(12) United States Patent
Conner

(10) Patent No.: US 8,517,609 B2
(45) Date of Patent: Aug. 27, 2013

(54) RESIZABLE FOOD CONTAINER

(76) Inventor: Christopher W. Conner, Maryville, TN (US)

( * ) Notice: Subject to any disclaimer, the term of this patent is extended or adjusted under 35 U.S.C. 154(b) by 1121 days.

(21) Appl. No.: 12/174,224

(22) Filed: Jul. 16, 2008

(65) Prior Publication Data

US 2009/0022431 A1 Jan. 22, 2009

Related U.S. Application Data

(60) Provisional application No. 60/950,737, filed on Jul. 19, 2007.

(51) Int. Cl.

| | |
|---|---|
| ***B65D 30/00*** | (2006.01) |
| ***B65D 65/26*** | (2006.01) |
| ***B65D 30/22*** | (2006.01) |
| ***B65D 33/16*** | (2006.01) |
| ***B65D 5/54*** | (2006.01) |
| ***B65D 5/00*** | (2006.01) |

(52) U.S. Cl.

USPC ..... 383/2; 383/37; 383/203; 383/205; 383/63; 383/38; 229/87.05; 229/101.2; 229/101.1; 229/101

(58) Field of Classification Search

USPC ..... 383/2, 37, 203–209, 63, 38; 229/87.05, 229/101.2, 101.1, 101

See application file for complete search history.

(56) References Cited

U.S. PATENT DOCUMENTS

| | | | | | |
|---|---|---|---|---|---|
| 2,078,227 | A | * | 4/1937 | Blum | 206/264 |
| 2,494,965 | A | * | 1/1950 | Rosen | 229/87.09 |
| 2,653,744 | A | * | 9/1953 | Behr | 141/10 |
| 2,986,321 | A | * | 5/1961 | Schaich | 229/101.2 |
| 3,539,093 | A | * | 11/1970 | Massengill | 229/101.1 |
| 4,576,283 | A | * | 3/1986 | Fafournoux | 206/524.8 |
| 4,736,450 | A | * | 4/1988 | Van Erden et al. | 383/65 |
| 5,158,499 | A | * | 10/1992 | Guckenberger | 206/524.2 |
| 5,167,608 | A | | 12/1992 | Steffens, Jr. et al. | |
| 5,186,543 | A | | 2/1993 | Cochran | |
| 5,352,041 | A | * | 10/1994 | Fullerton et al. | 383/5 |
| 5,409,115 | A | * | 4/1995 | Barkhorn | 206/440 |
| 5,461,845 | A | | 10/1995 | Yeager | |
| 6,060,095 | A | * | 5/2000 | Scrimager | 426/107 |

(Continued)

FOREIGN PATENT DOCUMENTS

| | | | |
|---|---|---|---|
| DE | 3150542 | * | 9/1982 |
| JP | 51-103173 | * | 9/1976 |
| JP | 2000062797 A | * | 2/2000 |

*Primary Examiner* — Nathan J Newhouse
*Assistant Examiner* — Latrice Byrd
(74) *Attorney, Agent, or Firm* — Knox Patents; Thomas A. Kulaga

(57) ABSTRACT

A container, or package, that is separable for resizing the container after the contents are partially consumed. One or more mid-package separable seals are positioned between the top and bottom of a package. The seal in the sealed configuration flexibly provides package integrity with an air-tight seal and connection. In the operated configuration, the seal separates the package into two sections, allowing the package to assume a size that is suitable for the volume of material remaining. In one embodiment, the mid-package separable seal includes a sealing strip that is adhesively attached to the outside of the package and covers a tear line/strip formed in the material of the package. Removal of the sealing strip allows the tear line to separate the package into two sections. In another embodiment, a connecting strip is attached to two sections of the package and the connecting strip has an integral tear line.

20 Claims, 4 Drawing Sheets

(56) References Cited

U.S. PATENT DOCUMENTS

| | | | | |
|---|---|---|---|---|
| 6,142,366 | A | 11/2000 | Sagel | |
| 6,238,090 | B1 * | 5/2001 | Yuter | 383/2 |
| 6,254,907 | B1 * | 7/2001 | Galomb | 426/115 |
| 6,273,608 | B1 * | 8/2001 | Ward et al. | 383/33 |
| 6,390,676 | B1 | 5/2002 | Colombo et al. | |
| 6,397,860 | B1 * | 6/2002 | Hill, II | 132/309 |
| 6,491,159 | B2 * | 12/2002 | Shibata | 206/219 |
| 6,579,008 | B2 * | 6/2003 | Price et al. | 383/38 |
| 6,609,998 | B2 * | 8/2003 | Lauzon et al. | 493/194 |
| 6,743,451 | B2 * | 6/2004 | Rasile et al. | 426/112 |
| 7,032,362 | B2 | 4/2006 | Dierl et al. | |
| 7,243,788 | B2 * | 7/2007 | Schmidt et al. | 206/221 |
| 7,597,691 | B2 * | 10/2009 | Kawaguchi et al. | 604/408 |
| 2001/0043763 | A1 * | 11/2001 | Saad et al. | 383/63 |
| 2003/0041563 | A1 * | 3/2003 | Schneider et al. | 53/412 |
| 2003/0236159 | A1 * | 12/2003 | Worthy, Jr. | 493/394 |
| 2004/0058039 | A1 * | 3/2004 | Strand et al. | 426/130 |
| 2004/0104135 | A1 * | 6/2004 | Kaneko et al. | 206/219 |
| 2004/0134802 | A1 * | 7/2004 | Inoue et al. | 206/219 |
| 2006/0008183 | A1 * | 1/2006 | Johansen | 383/61.2 |
| 2006/0072854 | A1 * | 4/2006 | Schreiter | 383/5 |
| 2007/0294931 | A1 * | 12/2007 | Kettles | 42/95 |

* cited by examiner

RESIZABLE FOOD CONTAINER

CROSS-REFERENCE TO RELATED APPLICATIONS

This application claims the benefit of U.S. Provisional Application No. 60/950,737, filed Jul. 19, 2007.

STATEMENT REGARDING FEDERALLY SPONSORED RESEARCH OR DEVELOPMENT

Not Applicable

BACKGROUND OF THE INVENTION

1. Field of Invention

This invention pertains to a food container that is separable and resealable. More particularly, this invention pertains to a food package, such as a potato chip bag, that is separable into parts, allowing the package to be resized to accommodate the quantity of food remaining in the package.

2. Description of the Related Art

Flexible containers are known for containing food products. Such containers typically have a bag-like structure made from a folded web or tube of thermoplastic film material. The bag-like structures have a sealed bottom and a sealed top, with the food product stored inside the air-filled bag. The sealed top is typically reclosable or resealable so that unconsumed food product can be stored in the container.

Flexible bag containers have proven popular for use with fragile, lightweight food products, such as potato chips and popcorn. Because such food products are lightweight, the bags often are large to accommodate sufficient food product for multiple servings. The larger, multiple serving bag sizes often have a sealed that that opens to form a resealable or a reclosable closure that allows the bag to be used until the contents are completely removed.

BRIEF SUMMARY OF THE INVENTION

The larger, multiple serving bags require that, as the contents are consumed, the user must extend a hand and forearm into the bag to reach the lowering level of the food product. Extending the arm into the bag such a distance potentially contaminates the inside of the bag, and, for oily food products, potentially soils the users clothing. In order to avoid requiring the user to extend a portion of his arm into the bag, the bag is separable into at least two sections where the upper section is removable from the bag to allow access to the contents in the lower section. According to one embodiment of the present invention, a food package, or container, such as a potato chip bag, is separable into smaller packages when the contents have been partially removed. The food package includes one or more mid-package separable seals that have two configurations. The first configuration (the sealing configuration) of the mid-package separable seal is one where the mid-package separable seal maintains the integrity of the food package by connecting two sections of the food package. The second configuration (the operated or open configuration) of the mid-package separable seal is one where the mid-package separable seal is operated to separate the food package into two sections. The mid-package separable seal includes an elongated strip that is secured or attached to two sections of the food package. The mid-package separable seal also includes a tear line, which is a weakened section that is configured to be torn in two, allowing the two sections of the food package to be separated.

In one embodiment, the food package, such as a potato chip bag, includes a perforation between the top and bottom of the package. That is, the perforation encircles the package and divides the package into two sections. The perforation is positioned and configured such that the package is separable into two sections when the contents of the package fall below the level of the perforation. The perforation is covered with a removable sealing strip. The removable sealing strip is dimensioned to attach to the food package on opposite sides of the perforation and encircle the package. In use, the removable seal is removed from the package and the package is torn into two pieces at the perforation. In one such embodiment, a sealing means, such as a zip-lock, is provided adjacent the perforation in order to seal the lower portion of the package after the top portion is removed. In another embodiment, a pull tab is attached to a pull string that is affixed to a perforated tear strip that encircles the food package. The pull tab is covered with the removable sealing strip or, in another embodiment, the pull tab is integral with the sealing strip. In still another embodiment, two sections of the package are sealed with a removable seal and a strip covers the seal and provides a mechanical connection bridging the seal. A tear string provides for breaking the strip's connection to the package.

In another embodiment, the food package is formed in two sections with a connecting strip encircling the package and joining the sections. The connecting strip has a weakened tear line, or portion, that allows the food package to be separable by tearing the connecting strip longitudinally. As in the first embodiment, a sealing means, such as a zip lock, is provided adjacent the perforation to seal the lower portion of the food package after the top portion is removed. In another such embodiment, the lower portion includes a pair of stiff tabs at opposite sides of the opening in the food package. After the open end of the food package is rolled up to close it, the tabs fold over to secure the closed top.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An apparatus for resizing a food package or container 102 is disclosed. Food packages are available in large sizes that contain more food than can be consumed at one time. The apparatus allows the food package 102 to be separable into progressively smaller packages to minimize the package volume to that necessary to contain and store the food remaining in the package.

Figure 1:
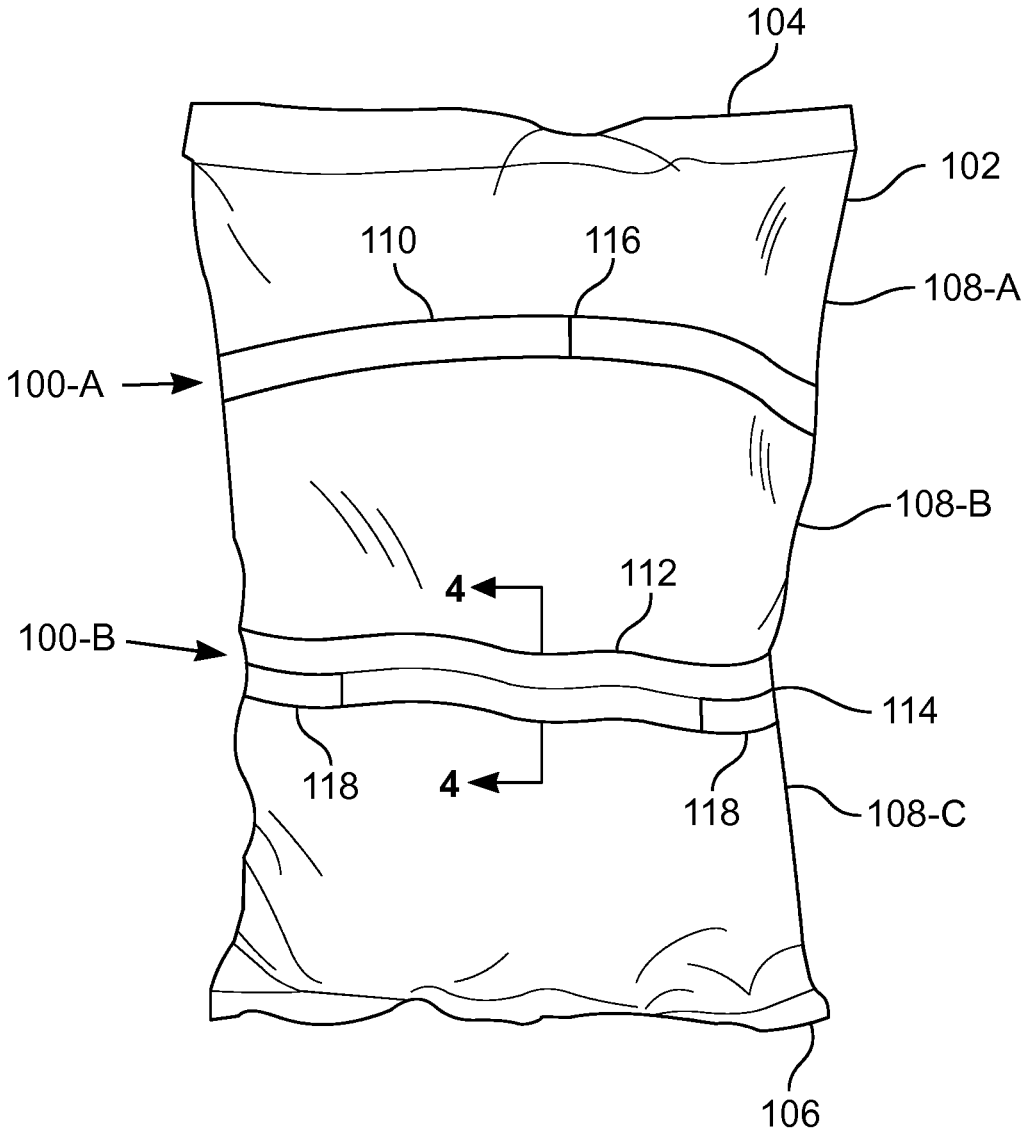
FIG. 1 is a perspective view of one embodiment of a food container illustrating two embodiments of a mid-package separable seal.

FIG. 1 illustrates a perspective view of one embodiment of a food container, or package, 102 illustrating two embodiments of a mid-package separable seal 100 in their sealing configuration. The food package 102 has a bag-like shape and is made of a flexible material, such as a plastic film or sheet. The food package 102 has a top 104 and a bottom 106. The top 104 opens to access the food inside the package 102, for example, potato chips or popcorn.

In the illustrated embodiment, the food package 102 is separable into progressively smaller packages. A first embodiment of a mid-package separable seal 100-A is located approximately one-third of the way down the package 102. The first mid-package separable seal 100-A connects two package sections 108-A and 108-B. A second embodiment of a mid-package separable seal 100-B is located approximately two-thirds of the way down the package 102. The second mid-package separable seal 100-B connects two package sections 108-B and 108-C. The mid-package separable seals 100, when in their initial, sealed configuration, are flexible and present a smooth surface that follows the contour of the food package 102 as the package 102 is handled. References to the top, middle, or lower sections 108 with respect to the various embodiments of the mid-package separable seals 100 is only for illustration.

The location and number of the mid-package separable seals 100 varies depending upon the size of the package 102 and the expected consumption rate of the contained foodstuff. For example, an elongated food package 102 has two or more mid-package separable seals 100 that permit the top of the package 102 to move progressively lower as the contents are removed, thereby ensuring that the arm of the person consuming the foodstuff does not have to reach an excessive distance into the food package 102. In another example, a food package 102 having a squat or square shape has only one mid-package separable seal 100 because the depth of the food package 102 is such that the foodstuff is readily accessible with the package 102 half-full.

Figure 2:
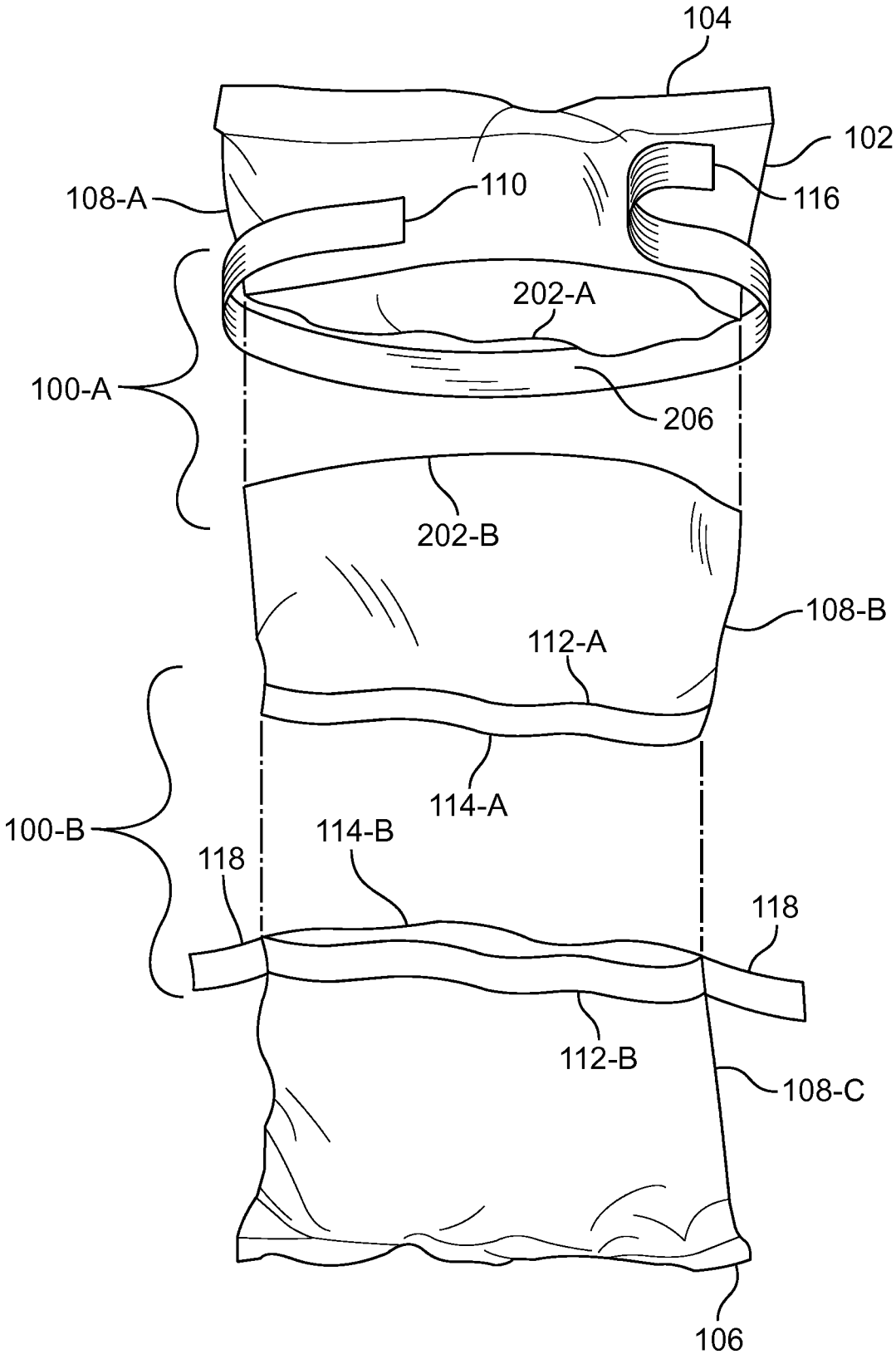
FIG. 2 is a perspective exploded view of one embodiment of the food container split into its several parts.

FIG. 2 illustrates a perspective exploded view of one embodiment of the food package, or container, 102 split into its several parts, or sections, 108-A, 108-B, 108-C. The upper mid-package separable seal 100-A, which is illustrated in its operated, or open, configuration, includes a removable sealing strip 110 that wraps around, or encircles, the food package 102. The inside surface 206 of the sealing strip 110, in one embodiment, has an adhesive that secures the sealing strip 110 to the outer surface of the food package 102. The sealing strip 110 is weakly attached to the food package 102 such that the strip 110 is readily removed by pulling on the end tab 116 and pealing the sealing strip 110 away from the outer surface of the food package 102. Removing the sealing strip 110 exposes a tear line 202.

In the illustrated embodiment, with the upper mid-package separable seal 100-A operated to separate the upper section 108-A from the remaining sections 108-B, 108-C of the food package 102, the elongated shape of the food package 102 is reduced by approximately one-third. The remaining sections 108-B, 108-C form a second bag section that is suitable for containing the portion of the food product that has not been consumed. The reduction in the depth of the food package 102 allows easier access to the remaining contents of the food package 102 and reduces the likelihood that a person's arm would contaminate the inside of the food package 102 or, in the case of oily foodstuffs, reduces the likelihood that a person's arm would be soiled by any residue adhering to the inside of the food package 102.

The top 202-B of the food package 102 formed by removing the upper section 108-A from the middle section 108-C allows access to the contents inside the food package 102 without having to traverse the upper section 108-A. In one embodiment, adjacent the newly formed top 202-B is a ziplock or other closure that allows the top 202-B of the middle section 108-B to be sealed to preserve the freshness of the contents of the package 102.

The illustrated embodiment of the lower mid-package separable seal 100-B, which is illustrated in its operated configuration, includes a connecting strip 112 that separates into two sections 112-A, 112-B at a tear line 114. The illustrated embodiment also includes a pair of stiff tabs 118. The tabs 118 are positioned adjacent the outer surface of the package 102 when the seal 100-B is in the connected, or sealed, configuration. The tabs 118 extend outward from the food package 102 after the middle section 108-B is separated from the lower section 108-C of the package 102. When the opening formed by removing the middle section 108-B from the lower section 108-C is closed by rolling the newly formed top, the stiff tabs 118 bend over the rolled top to secure the lower section 108-C in a closed configuration.

In the illustrated embodiment, with the lower mid-package separable seal 100-B operated to separate the middle section 108-B from the lower section 108-C of the food package 102, the elongated shape of the food package 102 is reduced to approximately one-third of its original size. Such a configuration is suitable for when the food package 102 is almost empty, but it is desired to store the remaining foodstuff.

The various methods of sealing and/or closing the newly formed tops after the mid-package separable seals 100 are operated to separate the sections 108 are examples only. Those skilled in the art will recognize that various types of package closure devices can be used without departing from the scope and spirit of the present invention.

Figure 3:
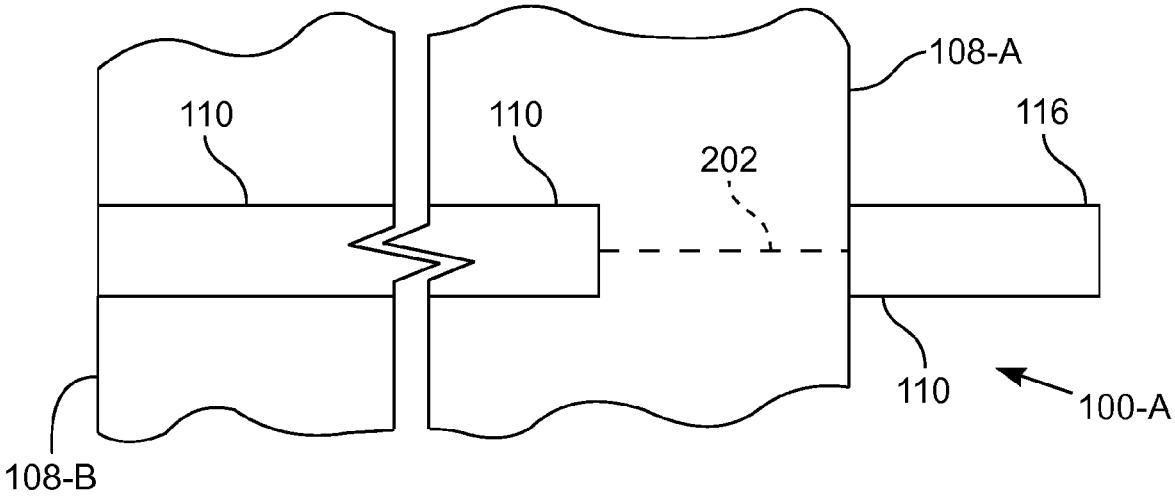
FIG. 3 is a partial front view of one embodiment of a mid-package separable seal.

FIG. 3 illustrates a partial front view of one embodiment of a mid-package separable seal 100-A. In the illustrated embodiment, the sealing strip 110 is shown secured to the package 102 with one end 116 lifted up and separated from the package 102. In the illustrated embodiment, the sealing strip 110 bridges a tear line 202 that is perforated. The sealing strip 100 is sufficiently wide to provide sufficient surface area to adhere to the two sections 108-A, 108-B of the food package 102. The end 116 of the sealing strip 110 overlaps the opposite end of the sealing strip 110 so that the perforation 202 is completely covered.

In the illustration, the two sections 108-A, 108-B of the package 102 are connected by the intact tear line 202. Because the tear line 202 is perforated, the sealing strip 110 seals the perforations, thereby maintaining the air-tight integrity of the package 102. The sealing strip 110 also provides structural support to the package 102 maintaining the two sections 108-A, 108-B together by adhering to a portion of each section 108-A, 108-B on opposite sides of the tear line 202. The surface 206 of the sealing strip 110 adjacent the outer surface of the package 102 has an adhesive that secures the sealing strip 110 to the package 102. In one embodiment, the adhesive is weak to tension, such as when the strip 110 is pulled away from the package 102, and the adhesive is strong in shear, such as when the two sections 108-A, 108-B are pulled apart.

Removing the sealing strip 102 exposes the tear line 202. The two sections 108-A, 108-B are separated by applying a tension force across the tear line 202 causing the material between the perforations to tear and separate. In another embodiment, the tear line 202 is a line of weakened material that separates when tension is applied across the tear line 202.

Figure 4:
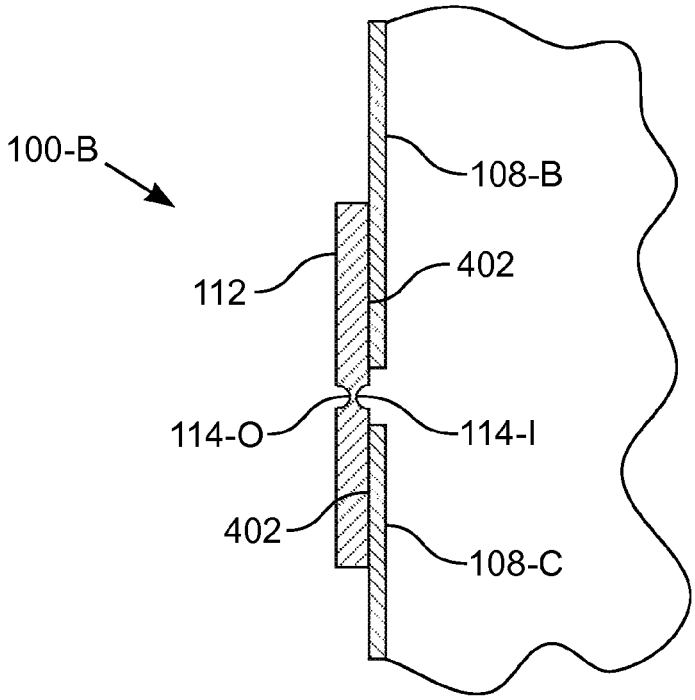
FIG. 4 is a cross-sectional partial side view of another embodiment of a mid-package separable seal.

FIG. 4 illustrates a partial cross-sectional side view of another embodiment of a mid-package separable seal 100-B.

The illustrated embodiment of the mid-package separable seal 100-B includes a connecting strip 112 that attaches to and connects two sections 108-B, 108-C of the food package 102. The food package 102 has separate sections 108-B, 108-C, with the ends of each section 108-B, 108-C attached to the connecting strip 112. The connecting strip 112 has an integral tear line 114 that is located between the edges of the two sections 108-B, 108-C. In the illustrated embodiment, the connecting strip 112 has a line of weakness 114 that includes an outside groove 114-O on its outside surface and an inside groove 114-I on its inside surface. The inside surface is adjacent the package 102 with the inside groove 114-I between the edges of the two sections 108-B, 108-C. The two grooves 114-O, 114-I on opposite surfaces of the connecting strip 112 form a weakened line that encircles the food package 102. Tension applied to the tear line 114 of the connecting strip 112 causes the connecting strip 112 to separate longitudinally at the tear line 114, thereby separating the package 102 into two sections 108-B, 108-C. In another embodiment, a single groove 114-O or 114-I provides a sufficiently weak joint that the connecting strip 112 is tearable.

The attachment 402 between the connecting strip 112 and the two sections 108-B, 108-C is by, in one embodiment, an adhesive disposed between the connecting strip 112 and the sections 108-B, 108-C, or, in another embodiment, by a welded or heat-sealed connection between the connecting strip 112 and the sections 108-B, 108-C. The connection 402 between the connecting strip 112 and the sections 108-B, 108-C is such that the contents of the package 102 are isolated from the outside environment by the connection 402. In the illustrated embodiment, with the mid-package separable seal 100-B in the sealing configuration, the connecting strip 112 is a structural member that holds the two sections 108-B, 108-C in a fixed relationship.

In another embodiment, the edges of the two sections 108-B, 108-C are also joined with a perforation adjacent the inside groove 114-I. Such an embodiment provides additional strength at the tear line while still allowing the two sections 108-B, 108-C to be separable.

Figure 5:
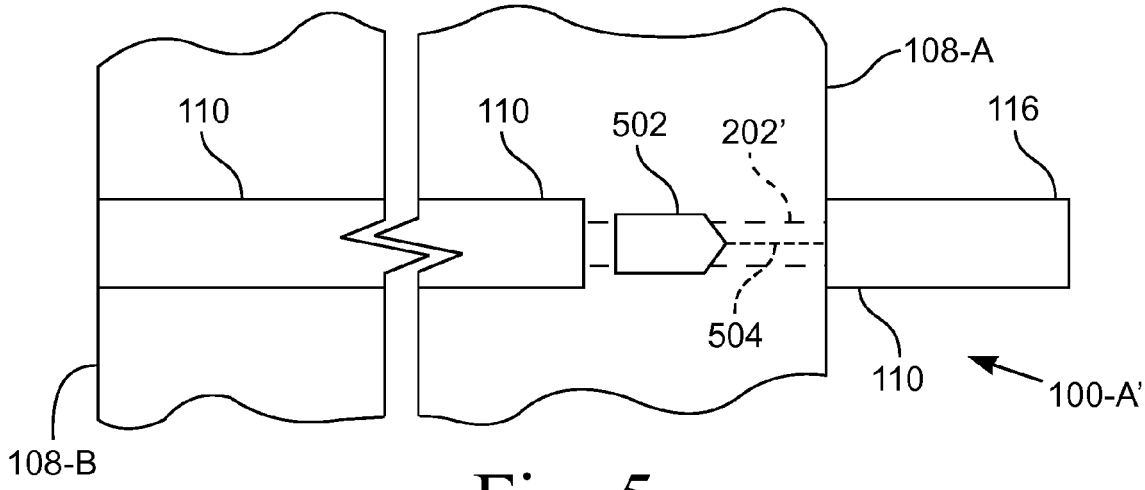
FIG. 5 is a partial front view of another embodiment of a mid-package separable seal.

FIG. 5 illustrates a partial front view of another embodiment of a mid-package separable seal 100-A'. In the illustrated embodiment, the sealing strip 110 is shown secured to the package 102 with one end 116 lifted up and separated from the package 102. In the illustrated embodiment, the sealing strip 110 bridges a tear strip 202' that is a strip of the package material with two parallel perforations that encircle the package 102. The sealing strip 100 is sufficiently wide to provide sufficient surface area to adhere to the two sections 108-A, 108-B of the food package 102 on either side of the tear strip 202'. The end 116 of the sealing strip 110 overlaps the opposite end of the sealing strip 110 so that the perforation 202' is completely covered.

The illustrated embodiment also includes a pull tab 502 that is in-line with the tear strip 202' and the pull tab 502 is attached to a pull string 504. The pull string 504 is fixed to the tear strip 202' such that when the pull tab 502 is lifted and pulled away from the package 102, the tear strip 202' detaches from the package 102 at the perforations, thereby separating the upper section 108-A from the middle section 108-B. In one such embodiment, the pull tab 502 is adhered to the inside surface 206 of the sealing strip 110 such that, when removing the sealing strip 110, the pull tab 502 is carried by the sealing strip 110 and the tearing strip 202' is removed from the package 102 in the same operation of removing the sealing strip 110. In other words, the upper section 108-A is separated from the middle section 108-B by removing the sealing strip 110, which carries the pull tab 504, which causes the tear strip 202' to separate from the package 102. In still another embodiment, the pull string 504 is attached directly to the sealing strip 110, in other words, the sealing strip 110 is the pull tab 502.

Figure 6:
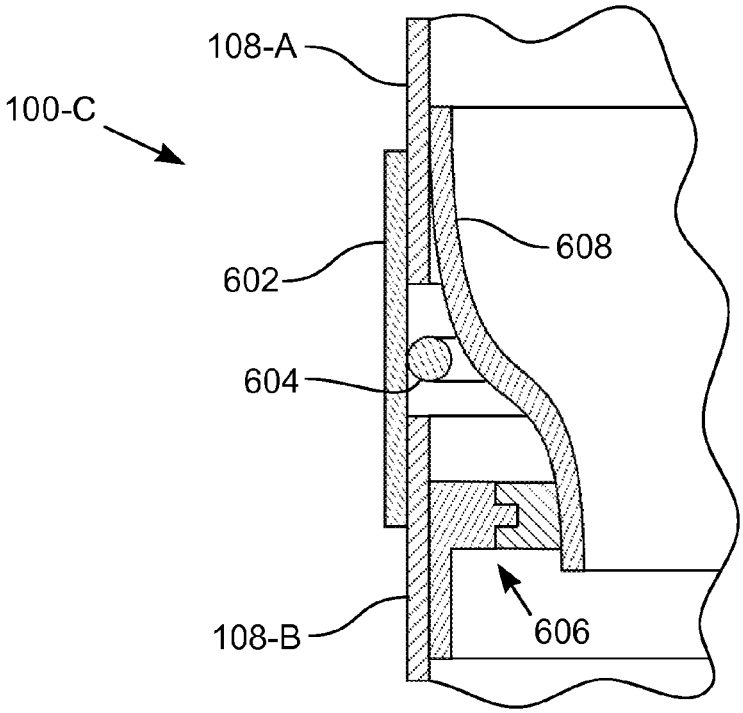
FIG. 6 is a cross-sectional partial side view of still another embodiment of a mid-package separable seal.

FIG. 6 illustrates a cross-sectional partial side view of still another embodiment of a mid-package separable seal 100-C shown in its sealed condition. The top section 108-A and the middle section 108-B are joined on the outside with a strip 602 that is attached to each section 108-A, 108-B. Inside the strip 602 is a pull string 604 connected to a tab that allows the pull string 604 to pull the strip 602 off the package 102. Attached to the top section 108-A is an extension 608 that extends below the upper edge of the middle section 108-B. Attached to the extension 608 is one-half of a removable seal 606 similar to a reclosable seal. The other half of the removable seal 606 is attached to the inside of the upped end of the middle section 108-B. To place the mid-package separable seal 100-C into the operated condition, the pull string 604 is pulled away from the package 102, which separates the strip 602 from the sections 108-A, 108-B by either splitting the strip 602 longitudinally or by pulling the strip 602 away from the package 102. After the strip 602 is removed, the removable seal 606 is broken by separating the two halves of the removable seal 606, thereby allowing the top section 108-A to separate from the middle section 108-C.

In the illustrated embodiment, the contents of the package 102 are sealed by the removable seal 606 and the strip 602 provides a mechanical connection between the sections 108-A, 108-B and a tamper evident seal. In one such embodiment, a reclosable seal is positioned below the removable seal 606 to allow closure of the middle section 108-B. In another such embodiment, the removable seal 606 is configured to close or lock onto itself, thereby allowing closure of the middle section 108-B.

The mid-package separable seal 100 includes various functions. The function of connecting two sections 108 of the food package 102 is implemented, in one embodiment, by the perforation 202, 202'. In one such embodiment, the sealing strip 110 also connects the two sections 108 by bridging the perforation 202. In another embodiment, the function of connecting is implemented by the connecting strip 112 that is attached to each of the two sections 108. In still another embodiment, the function of connecting is implemented by the strip 602 and the removable seal 606 as illustrated in FIG. 6.

The function of sealing the food package 102 is implemented, in one embodiment, by the sealing strip 110 that covers the perforation 202, 202'. In another embodiment, the function of sealing is implemented by the connecting strip 112 that bridges the gap between the two sections 108. In still another embodiment, the function of sealing is implemented by removable seal 606 as illustrated in FIG. 6.

The function of providing a tearable connection is implemented, in one embodiment, by the perforation 202, 202' joining two sections 108 of the food package. In another embodiment, the function of providing a tearable connection is provided by the connecting strip 112 with at least one groove 114-O, 114-I that allows the connecting strip 112 to be separable into two sections along a weakened longitudinal line. In still another embodiment, the function of providing a tearable connection is provided by the tear strip 202' joining two sections 108 of the food package, along with a pull tab 502 attached to a pull string 504 that is fixed to the tear strip 202' as illustrated in FIG. 5. In yet another embodiment, the function of providing a tearable connection is provided by the strip 602 with the pull string 604, working in conjunction with the removable seal 606 as illustrated in FIG. 6.

From the foregoing description, it will be recognized by those skilled in the art that a resizable food package 102 has been provided. At least one mid-package separable seal 100 is positioned away from the top 104 and the bottom 106 of the package 102. In its sealing configuration, the mid-package separable seal 100 maintains the integrity of the package 102 by joining and sealing the two sections 108. In the operated configuration, the mid-package separable seal 100 allows the package 102 to assume a smaller size that is suitable for containing the volume of material remaining in the package 102.

An apparatus forming a mid-package separable seal that allows a food package to be separable into two sections, said apparatus comprising: an elongated strip attached to two sections of the food package; and a tear line that encircles the food package between a top and a bottom of the food package, said tear line defining said two sections, said elongated strip and said tear line have a first configuration in which an integrity of the food package is maintained by connecting said two sections of the food package with an air-tight seal and a second configuration in which said two sections of the food package are separated such that one of said two sections is configured to contain a foodstuff and said one of two sections has a more than minimal reduction in volume compared to said two sections with said elongated strip and said tear line in said first configuration. One embodiment of the apparatus wherein said tear line is a perforation formed in the food package and the elongated strip covers said tear line. One embodiment of the apparatus wherein said tear line is a weakened section formed longitudinally in said elongated strip, and said two sections each having an edge adjacent said tear line.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for storing a food product, said apparatus comprising:

a bag formed of a flexible material, said bag configured to have a bottom seal and top seal for enclosing the food product therebetween, said bag defining a single volume between said bottom seal and said top seal, said bag having a reclosable opening adjacent said top seal; and a removable seal between said top seal and said bottom seal, said removable seal encircling said first volume, said removable seal having both an elongated strip and a tear line encircling said single volume, said removable seal dividing said bag into a first bag section and a second bag section, said removable seal having a sealed configuration and an operated configuration, said removable seal in said sealed configuration joining said first and second bag sections with a sealed connection such that said first and second bag sections define said single volume, said elongated strip connecting said first bag section and said second bag section in said sealed configuration, said removable seal in said open configuration defining an opening in said second bag section and separating said first bag section from said second bag section, said tear line defining said first and second bag sections, said opening resealable, said second bag section dimensioned to contain a specified portion of the food product.

2. The apparatus of claim 1 wherein said specified portion of the food product is between approximately one-third and two-thirds of the food product that said bag is dimensioned to store.

3. The apparatus of claim 1 wherein said elongated strip covers said tear line in said sealed configuration.

4. The apparatus of claim 1 wherein said tear line has a line of weakness, said tear line encircling said bag, said line of weakness being separated when said removable seal is in said operated configuration.

5. The apparatus of claim 1 wherein said removable seal further includes a pull string for removing said elongated strip from said bag.

6. The apparatus of claim 1 wherein said opening in said second bag section formed by said removable seal in said operated configuration is resealable.

7. The apparatus of claim 1 wherein said opening in said second bag section formed by said removable seal in said operated configuration is resealable with a zip-lock type closure.

8. An apparatus for storing a food product, said apparatus comprising:

a bag formed of a flexible material, said bag having a bottom seal, said bag having a first reclosable opening opposite said bottom seal, said bag between said bottom seal and said first reclosable opening defining a single volume; and a first removable seal encircling said bag between said bottom seal and said first reclosable opening, said removable seal having both an elongated strip and a tear line encircling said single volume, said first removable seal having a first configuration with said elongated strip joining a first bag section to a second bag section with a sealed connection, said first removable seal having a second configuration wherein said first bag section is separated from said second bag section at said tear line, said second bag section having a second reclosable opening adjacent said first removable seal wherein said second bag section is dimensioned to store a first portion of the food product and said second reclosable opening is resealable.

9. The apparatus of claim 8 wherein said first removable seal is located between approximately one-third and two-thirds of a distance between said first reclosable opening and said bottom seal of said bag.

10. The apparatus of claim 8 further including a second removable seal encircling said bag between said bottom seal and said first removable seal, said second removable seal having a first configuration joining a portion of said second bag section to a third bag section with a sealed connection, said second removable seal having a second configuration wherein said portion of said second bag section is separated from said third bag section, said third bag section having a third reclosable opening adjacent said second removable seal wherein said third bag section is dimensioned to store a second portion of the food product.

11. The apparatus of claim 10 wherein said first portion of the food product is approximately two-thirds of the food product that said bag is dimensioned to store and said second portion of the food product is approximately one-third of the food product.

12. The apparatus of claim 8 wherein said elongated strip covers said tear line in said first configuration.

13. The apparatus of claim 8 wherein said tear line has a line of weakness, said tear line encircling said bag, said line of weakness separating when said first removable seal is in said second configuration.

14. The apparatus of claim 8 wherein said first removable seal further includes a pull string for removing said elongated strip from said bag.

15. The apparatus of claim 8 wherein said second reclosable opening is resealable with a zip-lock type closure.

16. An apparatus forming a mid-package separable seal that allows a food package to be separable into two sections, said apparatus comprising:

a bag formed of a flexible material joined at a top and a bottom, said bag having a first section adjacent said top and a second section adjacent said bottom, said first and second sections defining a volume, said bag configured to store a food product;

an elongated strip encircling said bag and connecting said first section and said second section of said bag; and a tear line that encircles said bag between said first section and said second section of said bag, said tear line defining said first and second sections, said elongated strip and said tear line having a first configuration in which an integrity of said bag is maintained by connecting said first section to said second section with an air-tight seal, said elongated strip and said tear line having a second configuration in which said first section and said second section of said bag are separated such that said second section is dimensioned and configured to contain a portion of said food product and said second section has a more than minimal reduction in said volume of said bag and said second section is resealable when removed from said first section.

17. The apparatus of claim 16 wherein said tear line is a perforation formed in said bag and said elongated strip covers said tear line.

18. The apparatus of claim 16 wherein said tear line is a weakened section formed longitudinally in said elongated strip, and said first section and said second section each having an edge adjacent said tear line.

19. The apparatus of claim 16 wherein said second section is resealable after said first section is removed from said second section.

20. The apparatus of claim 16 wherein said tear line is located approximately one-half of a distance between said top and said bottom of said bag.

* * * * *